US008088231B2

(12) United States Patent
Woodfield et al.

(10) Patent No.: US 8,088,231 B2
(45) **Date of Patent: *Jan. 3, 2012**

(54) METHOD FOR PRODUCING A TITANIUM-BASE ALLOY HAVING AN OXIDE DISPERSION THEREIN

(75) Inventors: Andrew Philip Woodfield, Cincinnati, OH (US); Clifford Earl Shamblen, Blue Ash, OH (US); Eric Allen Ott, Cincinnati, OH (US); Michael Francis Xavier Gigliotti, Scotia, NY (US)

(73) Assignee: General Electric Company, Schenectady, NY (US)

( * ) Notice: Subject to any disclaimer, the term of this patent is extended or adjusted under 35 U.S.C. 154(b) by 74 days.

This patent is subject to a terminal disclaimer.

(21) Appl. No.: 12/834,046

(22) Filed: Jul. 12, 2010

(65) Prior Publication Data

US 2010/0288075 A1 Nov. 18, 2010

Related U.S. Application Data

(60) Continuation of application No. 11/351,226, filed on Feb. 9, 2006, now Pat. No. 7,763,127, which is a division of application No. 10/329,143, filed on Dec. 23, 2002, now Pat. No. 7,037,463.

(51) Int. Cl.
*C22C 14/00* (2006.01)

(52) U.S. Cl. ..... 148/421; 420/417; 75/245

(58) Field of Classification Search ..... 420/417; 148/421; 75/245

See application file for complete search history.

(56) References Cited

U.S. PATENT DOCUMENTS

| | | | |
|---|---|---|---|
| 3,737,300 | A | 6/1973 | Caims et al. |
| 4,512,826 | A | 4/1985 | Whang |
| 4,622,079 | A | 11/1986 | Chang et al. |
| 4,731,111 | A | 3/1988 | Kopatz et al. |

(Continued)

FOREIGN PATENT DOCUMENTS

EP 1441039 A2 7/2004

(Continued)

OTHER PUBLICATIONS

Hedrick, J.B., "Rare Earth Metals", Mineral Yearbook 1996, U.S. Department of the Interior, Geological Survey, Reston, 1997, pp. 61.1-61.6.

(Continued)

*Primary Examiner* — Jessee R. Roe

(74) *Attorney, Agent, or Firm* — McNees Wallace & Nurick LLC

(57) ABSTRACT

A metallic article is prepared by first furnishing at least one nonmetallic precursor compound, wherein all of the nonmetallic precursor compounds collectively containing the constituent elements of the metallic article in their respective constituent-element proportions. The constituent elements together form a titanium-base alloy having a stable-oxide-forming additive element therein, such as magnesium, calcium, scandium, yttrium, lanthanum, cerium, praseodymium, neodymium, promethium, samarium, europium, gadolinium, terbium, dysprosium, holmium, erbium, thulium, ytterbium, and lutetium, and mixtures thereof. The stable-oxide-forming additive element forms a stable oxide in a titanium-based alloy. At least one additive element is present at a level greater than its room-temperature solid solubility limit in the titanium-base alloy. The precursor compounds are chemically reduced to produce an alloy material, without melting the alloy material. The alloy material may be consolidated. The alloy material, or consolidated metallic article, is thereafter desirably exposed to an oxygen-containing environment at a temperature greater than room temperature.

20 Claims, 3 Drawing Sheets

U.S. PATENT DOCUMENTS

| | | | | |
|---|---|---|---|---|
| 4,851,053 | A | 7/1989 | Froes et al. | |
| 4,906,436 | A | 3/1990 | Gigliotti, Jr. et al. | |
| 4,915,905 | A | 4/1990 | Kampe et al. | |
| 4,999,336 | A | 3/1991 | Nadkami et al. | |
| 5,041,262 | A | 8/1991 | Gigliotti, Jr. | |
| 5,322,666 | A | 6/1994 | Watwe | |
| 5,421,917 | A * | 6/1995 | Partridge et al. | 148/407 |
| 5,431,874 | A | 7/1995 | Gigliotti, Jr. | |
| 5,779,761 | A | 7/1998 | Armstrong et al. | |
| 5,830,288 | A | 11/1998 | Gigliotti, Jr. et al. | |
| 5,930,580 | A | 7/1999 | Everett | |
| 5,958,106 | A | 9/1999 | Armstrong et al. | |
| 6,019,812 | A | 2/2000 | Volas et al. | |
| 6,264,719 | B1 | 7/2001 | Zhang et al. | |
| 6,737,017 | B2 | 5/2004 | Woodfield et al. | |
| 7,037,463 | B2 * | 5/2006 | Woodfield et al. | 419/19 |
| 7,763,127 | B2 * | 7/2010 | Woodfield et al. | 148/421 |

FOREIGN PATENT DOCUMENTS

| | | | |
|---|---|---|---|
| WO | 9843763 | A1 | 10/1998 |
| WO | 9964638 | A1 | 12/1999 |
| WO | 03106080 | A1 | 12/2003 |

OTHER PUBLICATIONS

Properties and Selection: Nonferrous Alloys and Special Purpose Materials: "Rare Earth Metals", ASM International, Oct. 1990, vol. 2, pp. 730-732, Materials Park, Ohio.

Properties and Selection: Nonferrous Alloys and Special Purpose Materials: "Introduction to Titanium and Titanium Alloys", Oct. 1990, vol. 2, pp. 586-591. Materials Park, Ohio.

* cited by examiner

METHOD FOR PRODUCING A TITANIUM-BASE ALLOY HAVING AN OXIDE DISPERSION THEREIN

CROSS-REFERENCE TO RELATED APPLICATIONS

This application is a continuation of U.S. application Ser. No. 11/351,226, filed Feb. 9, 2006, now U.S. Pat. No. 7,763,127, which itself is a division of 10/329,143, filed Dec. 23, 2002, now U.S. Pat. No. 7,037,463.

This invention relates to the production of articles made of titanium-base alloys and more particularly to the production of articles made of titanium-base alloys having elements therein which preferentially react with oxygen to produce an oxide dispersion.

BACKGROUND OF THE INVENTION

One of the most demanding applications of materials in aircraft gas turbine engines is the compressor and fan disks (sometimes termed "rotors") upon which the respective compressor blades and fan blades are supported. The disks rotate at many thousands of revolutions per minute, in a moderately elevated-temperature environment, when the gas turbine is operating. They must exhibit the required mechanical properties under these operating conditions.

Certain ones of the gas turbine engine components such as some of the compressor and fan disks are fabricated from titanium alloys. The disks are typically manufactured by furnishing the metallic constituents of the selected titanium alloy, melting the constituents, and casting an ingot of the titanium alloy. The'cast ingot is then converted into a billet. The billet is further mechanically worked, typically by forging. The worked billet is thereafter upset forged, and then machined to produce the titanium-alloy component.

Achieving the required mechanical properties at room and elevated temperatures, retaining sufficient environmental resistance, and preventing premature failure offer major challenges in the selection of alloy compositions and the fabrication of the articles. The chemistry and microstructure of the alloy must ensure that the mechanical properties of the article are met over the temperature range of at least up to about 1200° F. for current titanium-alloy components. The potentially deleterious effects of environmental exposure must be avoided. Small mechanical or chemical defects in the final component may cause it to fail prematurely in service, and these defects must be minimized or, if present, be detectable by available inspection techniques and taken into account. Such defects may include, for example, mechanical defects such as cracks and voids, and chemical defects such as hard alpha defects (sometimes termed low-density inclusions) and high-density inclusions. Hard alpha defects, discussed for example in U.S. Pat. Nos. 4,622,079 and 6,019,812, whose disclosures are incorporated by reference, are particularly troublesome in premium-quality alpha-beta and beta titanium alloys used in demanding gas turbine engine applications, as well as other demanding applications such as aircraft structures.

It has been possible, using existing melting, casting, and conversion practice, to prepare titanium-alloy components such as compressor and fan disks that are fully serviceable. However, there is always a desire and need for a manufacturing process to produce the disks and other components with even further-improved properties and greater freedom from defects, thereby improving the operating margins of safety.

The present invention fulfills this need for an improved process, and further provides related advantages.

BRIEF SUMMARY OF THE INVENTION

The present approach provides a method for producing a metallic article of a titanium-base alloy. The article has a good combination of mechanical properties in the temperature range up to about 1300° F., good resistance to environmental damage from oxidation, and a low incidence of defects. The present approach utilizes a production technique that allows the incorporation of alloying elements that cannot be readily introduced into titanium-base alloys in a usable form and distribution using conventional melting procedures.

A method for producing a metallic article made of constituent elements in constituent-element proportions comprises furnishing at least one nonmetallic precursor compound, wherein all of the nonmetallic precursor compounds collectively contain the constituent elements in their respective constituent-element proportions. The constituent elements comprise a titanium-base alloy, and a stable-oxide-forming additive element that forms a stable oxide in a titanium-based alloy. At least one additive element is present at a level greater than its room-temperature solid solubility limit in the titanium-base alloy. The precursor compounds are chemically reduced to produce an alloy material, without melting the alloy material.

The stable-oxide-forming additive element is a strong oxide former in a titanium-based alloy. Some stable-oxide-forming additive elements may not form a stable oxide where the titanium-based alloy has substantially no oxygen in solid solution, and instead require that there be up to about 0.25 weight percent oxygen in solution in order for the stable oxide to form. Such stable-oxide-forming additive elements are within the scope of the present approach, because such levels of oxygen may be present in the titanium-based alloy with the present approach. Thus, preferably, the titanium-base alloy has from zero to about 0.25 weight percent oxygen in solid solution. It may have greater amounts of oxygen in solid solution, although the ductility may be reduced if more than about 0.25 weight percent oxygen is present. Preferred stable-oxide-forming additive elements include magnesium, calcium, scandium, yttrium, lanthanum, cerium, praseodymium, neodymium, promethium, samarium, europium, gadolinium, terbium, dysprosium, holmium, erbium, thulium, ytterbium, and lutetium, and mixtures thereof. These elements cannot be introduced into titanium-base alloys at levels above their solubility limits using conventional melting techniques, because of their limited liquid phase miscibility, their reaction with the melting crucible, and/or the formation of coarse globs during solidification that result in deleterious effects to the properties.

The precursor compound or compounds are furnished in a form that is suitable for the selected chemical reduction technique. They may be furnished, for example, as metallic oxides or metallic halides. They may be furnished to the chemical reduction as a pre-compressed mass, preferably larger in size than the desired final article, in a finely divided form, or in a gaseous form.

The chemical reduction may be performed by any operable approach, as long as the alloy material is not melted. If it is melted, the subsequent resolidification results in a loss of many of the benefits of the present approach due to the solidification behavior of the stable-oxide-forming additive element(s). The preferred approach is a solid-phase reduction technique, wherein the precursor compounds and the reduced alloy material are not melted, although vapor phase reduction may be used as well. The reduction technique produces the alloy material in a physical form that is characteristic of the selected reduction technique. For example, the alloy material may be a metallic sponge or a plurality of metallic particles.

The preparation of the titanium alloy and the metallic article without melting has important benefits. Significantly in respect to the present approach, most stable-oxide-forming additive elements are not sufficiently miscible with molten titanium and titanium alloys to introduce large amounts into the melt and thence into the melted-and-cast titanum alloys, and/or those elements have minimal solubility in the titanium-based alloy with the result that after melting and casting a useful oxide-dispersion-containing structure cannot be achieved. If attempts are made to introduce a substantial amount of these stable-oxide-forming additive elements by melting and casting, the result is a chemical reaction with the environment or the molten metal and the presence of the stable-oxide-forming additive elements as large globs in the final article. These globs of material do not provide the oxygen reaction and oxygen-gettering properties achieved with the present approach.

Additionally, the production of the metallic alloy material and article without melting avoids the contamination and elemental segregation that are associated with the conventional sponge-making, melting, and casting processes. The metallic alloy material may be made without the introduction of the impurities which originate in the conventional metallic sponge-manufacturing process, and those associated with the melting and casting operations. The introduction of iron, chromium, and nickel from the sponge-producing vessels into titanium alloys is a particular concern, because these elements adversely affect the creep strength of the titanum alloys.

The oxygen content may be controlled prior to, and/or during, the reduction step, as described subsequently. The oxygen reacts with the stable-oxide-forming additive elements to produce a substantially uniformly distributed oxide dispersion in the metallic alloy matrix during the reduction step. The oxide dispersion improves the properties of the final metallic article, particularly in regard to the creep strength required at elevated temperatures.

After cooling to room temperature the alloy material is a titanium-base alloy with the stable-oxide-forming additive element(s) dispersed therethrough. The stable-oxide-forming additive element or elements are present in solid solution (either below the solubility limit or in a supersaturated state) and/or as one or more discrete dispersion phases. The dispersion phases may be unoxidized stable-oxide-forming additive elements or an already oxidized dispersion. The stable-oxide-forming additive elements that are in solid solution or a non-oxidized discrete dispersion are available for subsequent reaction with oxygen that may be in the matrix or diffuses into the metallic material in subsequent processing or service.

After the chemical reduction, the alloy material is preferably consolidated to produce a consolidated metallic article, without melting the alloy material and without melting the consolidated metallic article. Any operable consolidation technique, such as hot isostatic pressing, forging, pressing and sintering, or containered extrusion, may be used. The consolidation is preferably performed at as low a temperature as possible, to avoid coarsening the dispersion of particles. As in the earlier stages of the processing, if the metallic material is melted, upon resolidification the benefits are largely lost due to the solidification behavior of the stable-oxide-forming additive elements.

The consolidated metallic article may be mechanically formed as desired.

The material may be heat treated either after the chemical reduction step, after the consolidation step (if used), after mechanical forming, or subsequently.

In a typical application, the manufactured article is exposed to an oxygen-containing environment at a temperature greater than room temperature, and typically greater than about 1000° F., after the chemical reduction that places it into a metallic form. The exposure to oxygen causes at least some of the remaining unreacted portion of the stable-oxide-forming additive element(s) to chemically react with the oxygen diffusing into the material to form further oxide dispersoids in the material. The exposure to oxygen may be either during service or as part of a heat treatment prior to entering service, or both. When the exposure is during service, the oxygen-forming element(s) chemically combine with (i.e., getter) the oxygen that diffuses into the article from the environment. This reaction occurs most strongly near the surface of the article, so that the resulting dispersion of oxide dispersoids occurs primarily near the surface. When the exposure is as a part of a heat treatment, the depth of the oxide dispersion layer may be controlled to a specific value. In the event that the metallic article is very thin (e.g., about 0.005 inch or less), a uniform dispersion may be produced.

The formation of the oxide dispersion has several important benefits. First, a substantially uniformly distributed dispersion aids in achieving the desired mechanical properties, which are stable over extended periods of exposure at elevated temperature, through dispersion strengthening of the base-metal matrix, and also aids in limiting grain growth of the base-metal matrix. Second, when the exposure to oxygen occurs during a pre-service oxidation or during service, the oxygen diffusing into the article would normally cause the formation of an "alpha case" near the surface of conventional alpha-phase-containing titanium alloys. In the present approach, the stable-oxide-forming additive elements either in solution or as a separate phase getter the inwardly diffusing oxygen from solid solution and adding to the oxide dispersion, thereby reducing the incidence of alpha case formation and the associated possible premature failure. Third, in some cases the oxide dispersoids have a greater volume than the discrete metallic phases from which they were formed. The formation of the oxide dispersoids produces a compressive stress state that is greater near to the surface of the article than deeper in the article. The compressive stress state aids in preventing premature crack formation and growth during service. Fourth, the formation of a stable oxide dispersion at the surface of the article acts as a barrier to the inward diffusion of additional oxygen. Fifth, the removing of excess oxygen in solution from the matrix allows the introduction of higher alloying levels of alpha-stabilizer elements such as aluminum and tin, in turn promoting improved modulus of elasticity, creep strength, and oxidation resistance of the matrix. Sixth, the presence of excess oxygen in solution in some types of titanum alloys, such as alpha-2, orthorhombic, and gamma-based aluminides, reduces the ductility of the titanium alloy. The present approach getters that oxygen, so that the ductility is not adversely affected.

The present approach thus extends to an article comprising a titanium-alloy matrix, and a distribution of stable oxide dispersoids in the titanium-alloy matrix. The stable oxide dispersoids are an oxide of a stable-oxide-forming additive element that is present in an amount above its room temperature solid solubility limit in the titanium-alloy matrix. The titanium-alloy matrix does not have a melted-and-cast microstructure. Other compatible features discussed herein may be used in conjunction with this article.

The present approach thus provides a titanium-base metallic article with improved properties and improved stability. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
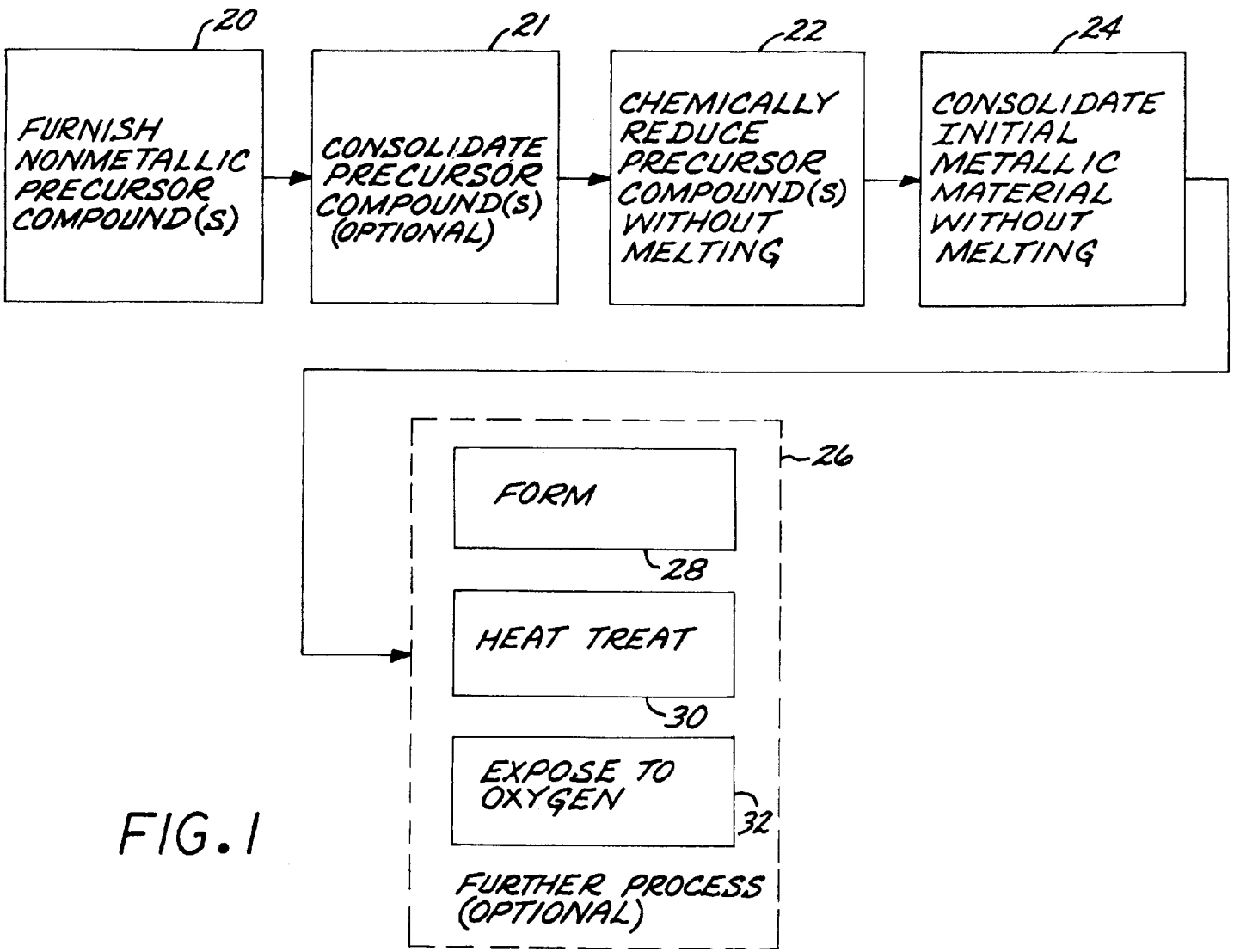
FIG. 1 is a block flow diagram of an approach for practicing the invention.

FIG. 1 depicts a preferred method for producing a metallic article made of constituent elements in constituent-element proportions. At least one nonmetallic precursor compound is furnished, step 20. All of the nonmetallic precursor compounds collectively contain the constituent elements in their respective constituent-element proportions. The metallic elements may be supplied by the precursor compounds in any operable way. In the preferred approach, there is exactly one non-oxide precursor compound for each alloying element, and that one precursor compound provides all of the material for that respective metallic constituent in the alloy. For example, for a four-element metallic material that is the final result of the process, a first precursor compound supplies all of the first element, a second precursor compound supplies all of the second element, a third precursor compound supplies all of the third element, and a fourth precursor compound supplies all of the fourth element. Alternatives are within the scope of the approach, however. For example, several of the precursor compounds may together supply all of one particular metallic element. In another alternative, one precursor compound may supply all or part of two or more of the metallic elements. The latter approaches are less preferred, because they make more difficult the precise determination of the elemental proportions in the final metallic material. The final metallic material is typically not a stoichiometric compound, having relative amounts of the metallic constituents that may be expressed as small integers.

The constituent elements comprise a titanium-base alloy, and a stable-oxide-forming additive element. A titanium-base alloy has more titanium by weight than any other element. Titanium alloys of particular interest include alpha-beta phase titanium alloys, beta-phase titanium alloys, alpha-2, orthorhombic, and gamma-phase titanium aluminide alloys, although the invention is not limited to these alloys. The stable-oxide-forming additive element is characterized by the formation of a stable oxide in a titanium-based alloy. An element is considered to be a stable-oxide-forming additive element if it forms a stable oxide in a titanium-base alloy, where the titanium-base alloy either has substantially no oxygen in solid solution or where the titanium-base alloy has a small amount of oxygen in solid solution. As much as about 0.25 weight percent oxygen in solid solution may be required for the stable-oxide-forming additive element to function as an effective stable-oxide former. Thus, preferably, the titanium-base alloy has from zero to about 0.25 weight percent oxygen in solid solution. Larger amounts of oxygen may be present, but such larger amounts may have an adverse effect on ductility. In general, oxygen may be present in a material either in solid solution or as a discrete oxide phase such as the oxides formed by the stable-oxide-forming additive elements when they react with oxygen.

Titanium has a strong affinity for and is highly reactive with oxygen, so that it dissolves many oxides, including its own. The stable-oxide-forming additive elements within the scope of the present approach form a stable oxide that is not dissolved by the titanium alloy matrix. Examples of stable-oxide-forming additive elements are strong oxide-formers such as magnesium, calcium, scandium, and yttrium, and rare earths such as lanthanum, cerium, praseodymium, neodymium, promethium, samarium, europium, gadolinium, terbium, dysprosium, holmium, erbium, thulium, ytterbium, and lutetium, and mixtures thereof.

At least one additive element is present at a level greater than its room-temperature solid solubility limit in the titanium-base alloy. After subsequent processing, each such additive element is partitioned into one of several forms. The additive element may be present as a non-oxide dispersion of the element. It may also be present in solid solution. It may also be present in a form that is reacted with oxygen to form a coarse oxide dispersion or a fine oxide dispersion. The coarse oxide dispersion forms by the reaction of the non-oxide dispersion of the element with oxygen that is typically present in the metallic matrix, thereby gettering the oxygen. The fine oxide dispersion forms by the reaction of the stable-oxide-forming additive element that is in solid solution, with oxygen that is in the matrix or diffuses into the metallic material from the surface during exposure to an oxygen-containing environment.

The precursor compounds are nonmetallic and are selected to be operable in the reduction process in which they are reduced to metallic form. In one reduction process of interest; solid-phase reduction, the precursor compounds are preferably metal oxides. In another reduction process of interest, vapor-phase reduction, the precursor compounds are preferably metal halides. Mixtures of different types of precursor compounds may be used.

The nonmetallic precursor compounds are selected to provide the necessary alloying elements in the final metallic article, and are mixed together in the proper proportions to yield the necessary proportions of these alloying elements in the metallic article. For example, if the final article were to have particular proportions of titanium, aluminum, vanadium, erbium, and oxygen in the ratio of 86.5:6:4:3:0.5 by weight, the nonmetallic precursor compounds are preferably titanium oxide, aluminum oxide, vanadium oxide, and erbium oxide for solid-phase reduction. The final oxygen content is controlled by the reduction process as discussed subsequently. Nonmetallic precursor compounds that serve as a source of more than one of the metals in the final metallic article may also be used. These precursor compounds are furnished and mixed together in the correct proportions such that the ratio of titanium:aluminum:vanadium:erbium in the mixture of precursor compounds is that required to form the metallic alloy in the final article.

Optionally, the nonmetallic precursor compounds may be pre-consolidated, step 21, prior to chemical reduction by techniques such as solid-phase reduction. The pre-consolidation leads to the production of a sponge in the subsequent processing, rather than particles. The pre-consolidation 21 is performed by any operable approach, such as pressing the nonmetallic precursor compounds into a pre-consolidated mass.

The single nonmetallic precursor compound or the mixture of nonmetallic precursor compounds is chemically reduced to produce metallic particles or sponge, without melting the precursor compounds or the metal, step 22. As used herein, "without melting", "no melting", and related concepts mean that the material is not macroscopically or grossly melted for an extended period of time, so that it liquefies and loses its shape. There may be, for example, some minor amount of localized melting as low-melting-point elements melt and are diffusionally alloyed with the higher-melting-point elements that do not melt, or very brief melting for less than about 10 seconds. Even in such cases, the gross shape of the material remains unchanged.

In one preferred reduction approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, titanium tetrachloride and the halides of the alloying elements are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy. The approach is described more fully in U.S. Pat. Nos. 5,779,761 and 5,958,106, whose disclosures are incorporated by reference.

Reduction at lower temperatures rather than higher temperatures is preferred. Desirably, the reduction is performed at temperatures of 600° C. or lower, and preferably 500° C. or lower. By comparison, prior approaches for preparing titanium- and other metallic alloys often reach temperatures of 900° C. or greater. The lower-temperature reduction is more controllable, and also is less subject to the introduction of contamination into the metallic alloy, which contamination in turn may lead to chemical defects. Additionally, the lower temperatures reduce the incidence of sintering together of the particles during the reduction step and limits the potential coarsening of the stable oxide dispersion.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, gaseous oxygen may be mixed with the gaseous nonmetallic precursor compound(s) to increase the level of oxygen, respectively, in the initial metallic particle. It is sometimes desirable, for example, that the oxygen content of the metallic material initially be sufficiently high to form coarse oxide dispersions by reaction with the stable-oxide-forming additive elements to strengthen the final metallic article. Rather than adding the oxygen in the form of solid titanium dioxide powder, as is sometimes practiced for titanium-base alloys produced by conventional melting techniques, the oxygen is added in a gaseous form that facilitates mixing and minimizes the likelihood of the formation of hard alpha phase in the final article. When the oxygen is added in the form of titanium dioxide powder in conventional melting practice, agglomerations of the powder may not dissolve fully, leaving fine particles in the final metallic article that constitute chemical defects. The present approach avoids that possibility.

In another reduction approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds, furnished in a finely divided solid form, is immersed in an electrolysis cell in a fused salt electrolyte such as a chloride salt at a temperature below the melting temperature of the alloy that forms from the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are partially or completely removed from the mixture by chemical reduction (i.e., the reverse of chemical oxidation). The reaction is performed at an elevated temperature to accelerate the diffusion of the oxygen or other gas away from the cathode. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a desired low level. The chlorides and mixtures of chlorides of barium, calcium, cesium, lithium, strontium, and yttrium are preferred. The chemical reduction is preferably, but not necessarily, carried to completion, so that the nonmetallic precursor compounds are completely reduced. Not carrying the process to completion is a method to control the oxygen content of the metal produced and to allow subsequent formation of the oxide dispersion. If the pre-consolidation step 21 is performed, the result of this step 22 may be a metallic sponge.

In another reduction approach, termed "rapid plasma quench" reduction, the precursor compound such as titanium chloride is dissociated in a plasma arc at a temperature of over 4500° C. The precursor compound is rapidly heated, dissociated, and quenched in hydrogen gas. The result is fine metallic-hydride particles. Any melting of the metallic particles is very brief, on the order of 10 seconds or less, and is within the scope of "without inciting" and the like as used herein. The hydrogen is subsequently removed from the metallic-hydride particles by a vacuum heat treatment. Oxygen may also be added to react with the stable-oxide-forming additive elements to form the stable oxide dispersion.

Whatever the reduction technique used in step 22, the result is an alloy material. The alloy material may be free-flowing particles in some circumstances, or have a sponge-like structure in other cases. The sponge-like structure is produced in the solid-phase reduction approach if the precursor compounds have first been pre-compacted together (i.e., optional step 21) prior to the commencement of the actual chemical reduction. The precursor compounds may be compressed to form a compressed mass that is larger in dimensions than a desired final metallic article.

Optionally but preferably, the alloy material is consolidated to produce a consolidated metallic article, step 24, without melting the alloy material and without melting the consolidated metallic article. The consolidation step 24 may be performed by any operable technique, with examples being hot isostatic pressing, forging, pressing and sintering, and containered extrusion.

Figure 2:
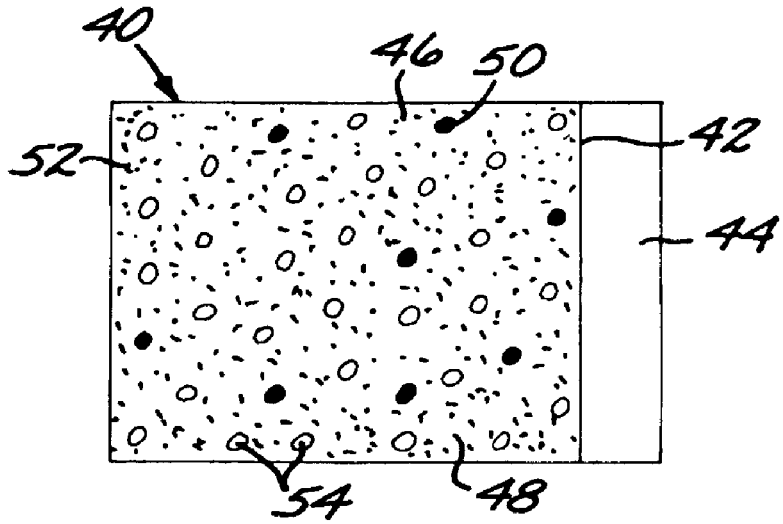
FIG. 2 is an idealized microstructure of the metallic article, after some oxidation that produces a uniform oxide dispersion.

FIG. 2 illustrates the microstructure of the metallic article 40 having a surface 42 facing the environment 44. The metallic article 40 has a microstructure of a titanium-base alloy matrix 46 with the stable-oxide-forming additive element(s) dispersed therethrough. The stable-oxide-forming additive element(s) may be present in solid solution, numeral 48, or as one or more unreacted discrete phases 50. Some of the stable-oxide-forming additive element(s) initially in solid solution may have reacted with oxygen initially present in the matrix 46 to form a dispersion of fine oxide dispersoids 52. Some of the stable-oxide-forming additive element(s) initially present as unreacted discrete phase 50 may have reacted with oxygen initially present in the matrix 46 to form a dispersion of coarse oxide dispersoids 54. (As used herein, "coarse" and "fine" are used only in a relative sense to each other, with "coarse" dispersoids being larger in size than "fine" dispersoids. Both the coarse oxide dispersoids and the fine oxide dispersoids provide strengthening effects.) These stable oxide dispersoids 52 and 54 are distributed substantially uniformly throughout the matrix 44.

Optionally but preferably, there is further processing, step 26, of the consolidated metallic article. In this processing, the article is not melted. Such further processing may include, for example, mechanically forming the consolidated metallic article, step 28, by any operable approach, or heat treating the consolidated metallic article, step 30, by any operable approach. The forming step 28 and/or the heat treating step 30, where used, are selected according to the nature of the titanium-base alloy. Such forming and heat treating are known in the art for each titanium-base alloy.

The metallic article is preferably exposed to an oxygen-containing environment at a temperature greater than room temperature, step 32. The oxygen exposure step 32, leading to the types of microstructures shown in FIG. 3, may be either during the initial preparation of the metallic article, in a controlled production setting, or during later service exposure at elevated temperature. In either case, the oxygen diffuses inwardly from the surface 42 into the matrix 46. The inwardly diffused oxygen chemically reacts with the oxide-forming additive element(s) that are present near the surface 42 either in solid solution 48 or in discrete phases 50. The result is that few if any unreacted stable-oxide-forming additive elements in solid solution 48 or in discrete phases 50 remain near the surface 42, and instead are all reacted to form, respectively, additional fine oxide dispersoids 52 and coarse oxide dispersoids 54. Consequently, there is a higher concentration of fine-oxide dispersoids 52 in a diffusion-oxidation zone 56 of depth D1 at and just below the surface 42, as compared with the concentration of the fine-oxide dispersoids 52 at greater depths. D1 is typically in the range of from about 0.001 to about 0.003 inches, but may be smaller or larger. Additionally, depending upon the specific oxides formed by the stable-oxide forming elements, there may be formed an oxide surface layer 58 that serves as a diffusion barrier to the diffusion of additional oxygen from the environment 44 into the article 40.

Figure 3:
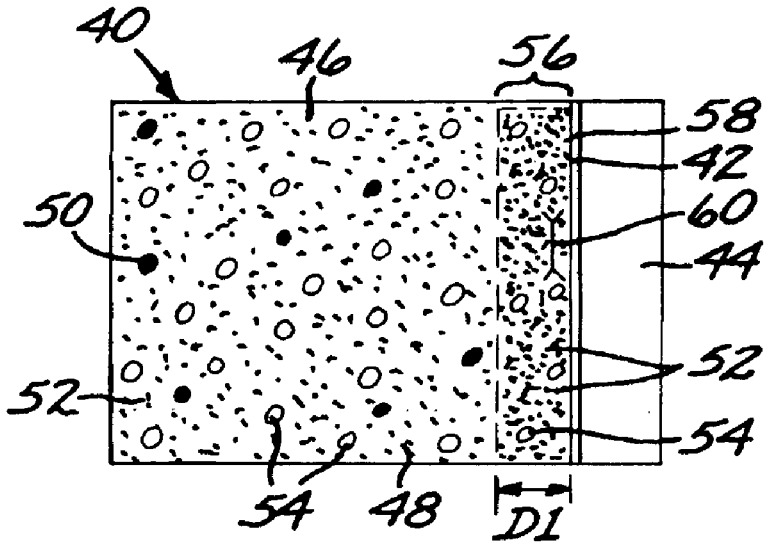
FIG. 3 is an idealized microstructure of the metallic article, after inward diffusion of oxygen during heat treatment or service.
Figure 4:
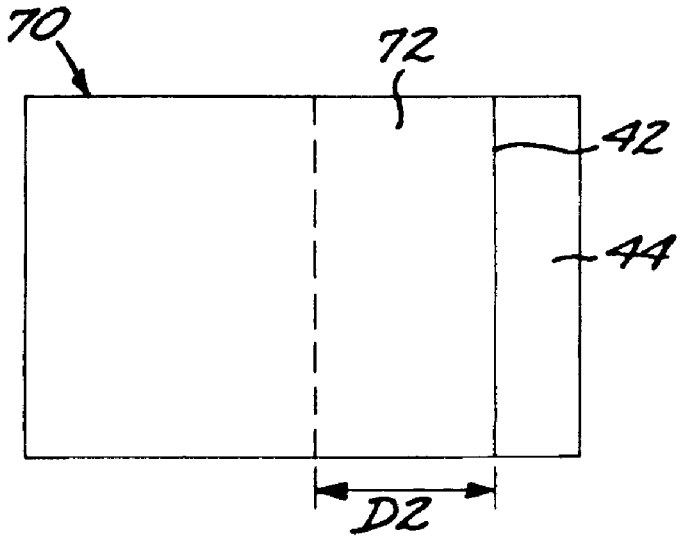
FIG. 4 is an idealized microstructure of a conventional metallic article, after inward diffusion of oxygen.

This structure is to be distinguished from that shown in FIG. 4, a conventional titanium alloy article 70 that is outside the scope of the present approach. In this case, during exposure to an oxygen-containing environment during processing and/or service, oxygen diffuses from the environment 44, through the surface 42, and into the base metal of the article 70 to a depth D2, which is typically from about 0.003 to about 0.005 inch. The excess oxygen reacts with and embrittles the alpha-phase titanium in this region to form an alpha case 72. In the present approach as illustrated in FIG. 3, on the other hand, the gettering of the inwardly diffusing oxygen by the stable oxide-forming additive elements and the oxide surface layer 58 combined to reduce and, desirably, avoid the formation of such an oxygen-stabilized alpha case.

The presence and the nature of the distribution of the oxide dispersoids 52 and 54 has several additional important consequences. The oxide dispersoids 52 and 54 serve to strengthen the matrix 46 by the dispersion-strengthening effect and also to improve the elevated-temperature creep strength of the matrix 46. The oxide dispersoids 52 and 54 may also pin grain boundaries of the matrix 46 to inhibit coarsening of the grain structure during processing and/or elevated temperature exposure. Additionally, in some circumstances the oxide dispersoids 52 and 54 have a higher specific volume than the stable oxide-forming additive elements from which they are produced. This higher specific volume creates a compressive force, indicated by arrow 60, in the matrix 46 near the surface 42. The compressive force 60 inhibits crack formation and growth when the article is loaded in tension or torsion during service, a highly beneficial result.

Figure 5:
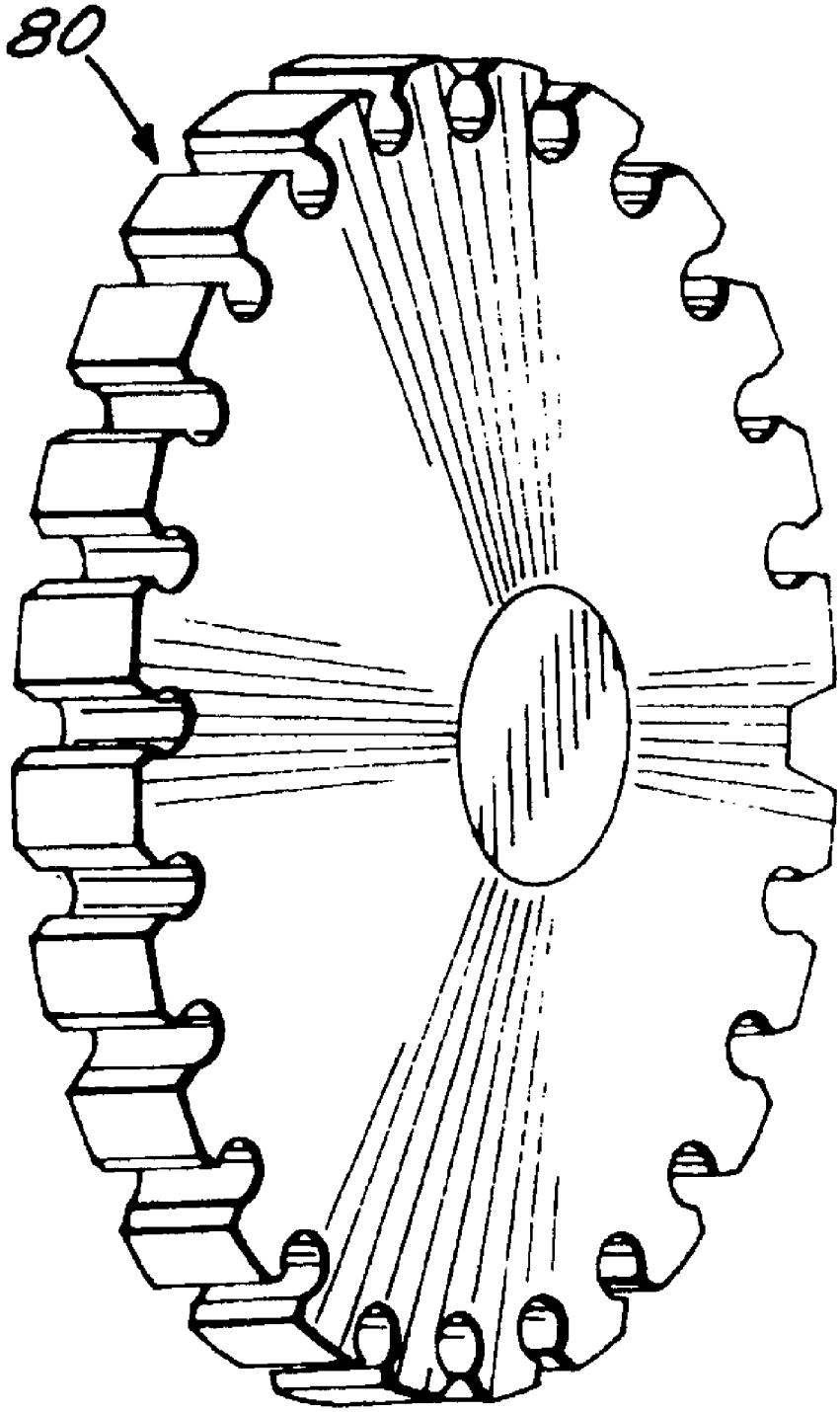
FIG. 5 is a perspective view of a gas turbine component made by the present approach.

FIG. 5 illustrates an example of a metallic article 80 made by the present approach. The illustrated article 80 is a component of a gas turbine engine, and specifically a compressor disk or a fan disk. Other examples of articles 80 that are components of gas turbine engines include blisks, shafts, cases, engine mounts, stator vanes, seals, and housings. The use of the present invention is not limited to these particular articles, however.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A metallic article made of constituent elements in constituent-element proportions, wherein the article was produced by a method comprising the steps of:

furnishing at least one nonmetallic precursor compound, wherein all of the nonmetallic precursor compounds collectively contain the constituent elements in their respective constituent-element proportions, and wherein the constituent elements comprise titanium, at least one alloying element capable of alloying with titanium and present in proportions to form a titanium-base alloy, and an additive element selected from the group consisting of magnesium, calcium, scandium, yttrium, lanthanum, cerium, praseodymium, neodymium, promethium, samarium, europium, gadolinium, terbium, dysprosium, holmium, erbium, thulium, ytterbium, and lutetium, and mixtures thereof, and wherein at least one additive element is present at a level greater than its room-temperature solid solubility limit in the titanium-base alloy;

chemically reducing the precursor compounds to produce a titanium-base alloy material; and consolidating the alloy material to produce a consolidated metallic article;

wherein each step in producing the metallic article is performed without melting for any more than about 10 seconds, and wherein the produced article has a matrix in which a first set of stable oxide dispersoids and a second set of stable oxide dispersoids are both dispersed therein, wherein the first set of stable oxide dispersoids are coarse relative to the second set of stable oxide dispersoids and the article further includes the additive element present in an unreacted discrete phase and in solid solution.

2. The metallic article of claim 1, wherein the at least one alloying element is selected from aluminum, vanadium, or tin.

3. The metallic article of claim 1, wherein the step of furnishing at least one nonmetallic precursor compound includes the step of furnishing a compressed mass of the at least one nonmetallic precursor compound.

4. The metallic article of claim 1, wherein the step of furnishing at least one nonmetallic precursor compound includes the step of furnishing at least one nonmetallic precursor compound comprising metallic-oxide precursor compounds.

5. The metallic article of claim 1, wherein the step of chemically reducing includes the step of controlling the oxygen content.

6. The metallic article of claim 1, wherein the step of chemically reducing includes the step of producing a sponge of the alloy material.

7. The metallic article of claim 1, wherein the step of chemically reducing includes the step of producing particles of the alloy material.

8. The metallic article of claim 1, wherein the step of chemically reducing includes the step of chemically reducing the mixture of nonmetallic precursor compounds by solid-phase reduction.

9. The metallic article of claim 1, wherein the step of chemically reducing includes the step of chemically reducing the compound mixture by vapor-phase reduction.

10. The metallic article of claim 1, wherein the step of consolidating includes the step of consolidating the alloy material using a technique selected from the group consisting of hot isostatic pressing, forging, pressing and sintering, and containered extrusion.

11. The metallic article of claim 1, wherein the method includes an additional step, after the step of consolidating, of forming the consolidated metallic article.

12. The metallic article of claim 1, wherein the method includes an additional step, after the step of consolidating, of exposing the consolidated metallic article to an oxygen-containing environment at a temperature greater than room temperature.

13. A metallic article made of constituent elements in constituent-element proportions, wherein the article was produced by a method comprising the steps of:

furnishing at least one nonmetallic precursor compound, wherein all of the nonmetallic precursor compounds collectively contain the constituent elements in their respective constituent-element proportions, and wherein the constituent elements comprise titanium, at least one alloying element capable of alloying with titanium and present in proportions to form a titanium-base alloy, and a stable-oxide-forming additive element that forms a stable oxide in a titanium-based alloy, and wherein at least one additive element is present at a level greater than its room-temperature solid solubility limit in the titanium-base alloy; and chemically reducing the precursor compounds to produce an alloy material, wherein each step in producing the metallic article is performed without melting for any more than about 10 seconds, and wherein the produced article comprises a metallic sponge.

14. The metallic article of 13, wherein the step of furnishing includes the step of providing the stable-oxide-forming additive element selected from the group consisting of magnesium, calcium, scandium, yttrium, lanthanum, cerium, praseodymium, neodymium, promethium, samarium, europium, gadolinium, terbium, dysprosium, holmium, erbium, thulium, ytterbium, and lutetium, and mixtures thereof.

15. The metallic article of claim 13, wherein the step of furnishing at least one nonmetallic precursor compound includes the step of furnishing at least one nonmetallic precursor compound comprising metallic-oxide precursor compounds.

16. The metallic article of claim 13, wherein the step of chemically reducing includes the step of chemically reducing the mixture of nonmetallic precursor compounds by solid-phase reduction or vapor-phase reduction.

17. The metallic article of claim 13, wherein the method includes an additional step, after the step of chemically reducing, of exposing the alloy material to an oxygen-containing environment at a temperature greater than room temperature.

18. The metallic article of claim 13, wherein the titanium-base alloy has from zero to about 0.25 weight percent oxygen in solid solution.

19. A metallic article made of constituent elements in constituent-element proportions, wherein the article was produced by a method comprising the steps of:

furnishing at least one nonmetallic precursor compound, wherein all of the nonmetallic precursor compounds collectively contain the constituent elements in their respective constituent-element proportions, and wherein the constituent elements comprise titanium, at least one alloying element capable of alloying with titanium and present in proportions to form a titanium-base alloy, and a stable-oxide-forming additive element that forms a stable oxide in a titanium-based alloy, and wherein at least one additive element is present at a level greater than its room-temperature solid solubility limit in the titanium-base alloy;

chemically reducing the precursor compounds to produce an alloy material; and consolidating the alloy material to produce a consolidated metallic article;

wherein each step in producing the metallic article is performed without melting for any more than about 10 seconds, and wherein the produced article has a matrix in which a first set of stable oxide dispersoids and a second set of stable oxide dispersoids are both dispersed therein, wherein the first set of stable oxide dispersoids are coarse relative to the second set of stable oxide dispersoids and the article further includes the additive element present in an unreacted discrete phase and in solid solution.

20. The metallic article of claim 19, wherein the step of furnishing includes the step of providing the stable-oxide-forming additive element selected from the group consisting of magnesium, calcium, scandium, yttrium, lanthanum, cerium, praseodymium, neodymium, promethium, samarium, europium, gadolinium, terbium, dysprosium, holmium, erbium, thulium, ytterbium, and lutetium, and mixtures thereof.

* * * * *